United States Patent [19]

Panush et al.

[11] Patent Number: 4,547,410

[45] Date of Patent: Oct. 15, 1985

[54] PROCESS FOR APPLYING A MULTI-LAYER PAINT CONTAINING MICA PIGMENT

[75] Inventors: Sol Panush, Farmington Hills; James M. Gelmini, Warren; David M. Varcak, Detroit, all of Mich.

[73] Assignee: Inmont Corporation, Clifton, N.J.

[21] Appl. No.: 563,831

[22] Filed: Dec. 21, 1983

[51] Int. Cl.[4] ..... B05D 1/02

[52] U.S. Cl. ..... 427/388.2; 427/388.1; 427/409; 427/421; 427/31

[58] Field of Search ..... 427/31, 388.1, 388.2, 427/409, 421

[56] References Cited

U.S. PATENT DOCUMENTS

| | | | |
|---|---|---|---|
| 3,087,829 | 4/1963 | Linton | 106/291 |
| 3,639,147 | 2/1972 | Benefiel et al. | 427/389.7 |
| 4,146,403 | 3/1979 | Armanini et al. | 106/291 |
| 4,220,675 | 9/1980 | Imazaki | 427/27 |
| 4,442,135 | 4/1984 | Snaddon | 427/31 |

FOREIGN PATENT DOCUMENTS

| | | | |
|---|---|---|---|
| 00963 | 4/1982 | European Pat. Off. | 427/407 |

OTHER PUBLICATIONS

Tholome et al., Industrial Finishing, Nov. 1977, pp. 30–35.

C. J. Rieger, "Use of Non-Metallic Pearlescent Pigments to Achieve Metallic Appearance", Presented at 37th SPE Annual Technical Conference, New Orleans, LA, May 9, 1979.

Joseph E. Ziegeweid, "Applying Organic Coatings", Metal Finishing pp. 21–25.

*Primary Examiner*—Richard Bueker

*Attorney, Agent, or Firm*—C. G. Nessler

[57] ABSTRACT

Polymer coatings having high solids content and containing mica pigments are applied with uniform appearance when the liquid layer which is deposited on an article is greater in thickness than the nominal maximum length of the mica platelets. Coatings which contain 0.01–5 weight percent mica having up to 60 micrometers maximum platelet length are produced in thicknesses of 0.045–0.076 mm. The coatings are best applied by a conventional turbobell rotary atomizer.

9 Claims, No Drawings

PROCESS FOR APPLYING A MULTI-LAYER PAINT CONTAINING MICA PIGMENT

TECHNICAL FIELD

The present invention relates to the method of applying a multilayer coating of enamel onto a substrate, particularly where the enamel contains carefully controlled amounts of fine mica particulate.

BACKGROUND

This application is related to commonly owned patent application Ser. No. 518,583 filed on July 29, 1983 by S. Panush for "Pearlescent Automotive Paint Composition", now abandoned, which application is a continuation-in-part of Ser. No 440,764 filed on Nov. 10, 1982 now abandoned. It is more closely related to commonly owned patent application Ser. No. 526,724, filed on Aug. 26, 1983 by S. Panush for "Multilayer Automotive Paint System" now U.S. Pat. No. 4,499,143. The foregoing patent applications describe the compositions and structures of improved paints which are particularly useful in the automotive industry.

U.S. Pat. No. 3,639,147 discloses an older basic multilayer painting system which has found particularly wide use in the automotive industry and is commonly referred to as a basecoat/clearcoat system. According to this system, a substantially pigmented basecoat layer is applied to a metal substrate to provide aesthetically pleasing colors and to hide surface blemishes. For a particular pleasing effect, the basecoat will contain metallic pigments such as aluminum flake. A clearcoat layer is next applied over the basecoat. Typically this is a substantially unpigmented layer of polymer which "deepens" the color appearance of the basecoat and provides durability in that it seals the topmost pigment particles of the basecoat from the environment. In this system and in the others referred to herein, additional clearcoats are optional, for the same reason.

While the foregoing system has met with wide use and provides a substantial improvement over previous one coat systems (or systems where multiple layers of the same composition were applied to a surface) the need for further improvements has been evident. Particularly, there is a continuing desire to improve the durability of coatings, to provide new and exciting aesthetic effects, and in most recent years, to reduce the solvent content of paints for atmospheric environmental reasons. The above mentioned co-pending applications provide a substantial improvement in the desired direction. The new coatings of the patent applications are notable because they contain Richelyn pigments (trademark of Inmont Corporation); these are very fine mica flake particulates having extremely thin transparent coatings on their surfaces. Coated mica pigments are described in U.S. Pat. No. 3,087,829. The mica pigment is placed in the basecoat of the first two patent applications referred to above, to provide a pearlescent appearance in an automotive paint; and, the second topcoat is clear. In the system which is the subject of the Ser. No. 526,724 application, the basecoat contains a substantial amount of the Richelyn pigment, while the topcoat contains a relatively small amount. This composition of enamel provides a quite different appearance to a coating, compared to the Richelyn pigmented basecoat with a clear topcoat, and compared to an aluminum pigmented basecoat with a clear topcoat, i.e., the familiar commercial coating.

This application is concerned with the method of applying the above mentioned Richelyn pigmented coatings, and especially that of patent application Ser. No. 526,724. Of course, there are numerous well known methods for applying conventional coating systems to surfaces. Most favored in production situations are: two-fluid atomizing, wherein air provides the driving force to atomize and impel the paint toward the workpiece surface; simple pressure atomizing, wherein the paint is raised to a sufficiently high pressure for it to atomize upon issuing from an extremely small orifice; and, rotary atomizing, where the liquid is flowed across the surface of a disc or bell shaped rotating member and disintegrated by Rayleigh breakup at the edge. Electrostatic charges may be applied to the foregoing apparatuses to cause charged paint particles to move toward a conductive workpiece surface. In particular, electrostatically assisted disc and bell rotary atomizers have been particularly favored in the automotive industry. It is not unusual for air to be utilized to supplement the action of a rotary atomizer and electrostatic force, to more efficiently guide the atomized paint particles toward the workpiece surface.

Notwithstanding all the past experience and technology which is available for applying paint systems to automobiles and other articles, it has been discovered with the new coating systems that the desired aesthetic effects and durability are not fully realized under all atomizing conditions. As with prior coating systems, there is a criticality in matching appearance of parts coated at different times. Particularly, in automotive applications there is a need for matching between portions of a vehicle which might be coated by air atomizing and those coated by electrostatic rotary atomizing. High solids content mandated by environmental regulations adds to the problem by making spray parameters more critical. The variations in appearance, both within the use of a particular method and between different coating methods, have been found to be greater for Richelyn pigmented coatings than for aluminum pigmented coatings. In our work we have attributed this difference to the nature of the mica particulate. Thus, development work was undertaken to discover the phenomena underlying the observed variability and to determine how to satisfactorily reproduce coating appearance. And of course it is an important criterion that, whatever the appearance, the coating must satisfactorily perform its protective function as well.

DISCLOSURE OF THE INVENTION

An object of the invention is to apply mica containing coatings in a manner which preserves their desirable appearance from one article to another, and from the use of one method to another.

According to the invention, a hardened coating containing up to 5 weight percent ceramic pigment platelets such as mica is produced by spraying onto the surface of an article a liquid layer having a thickness which is at least as great as the nominal maximum length of platelet. The method of the invention tends to permit predominately random orientation of the pigment, and thus will provide uniformity of coating appearance in one application compared to another. The invention is most pertinent to polymer binder coatings which contain more than 40 volume percent solids and which contain 0.001–5 weight percent mica pigments having platelet thickness of 0.25–1 micrometer and platelet maximum lengths of nominally 5–60 micrometers. The coatings of the invention using the foregoing compositions will be deposited in liquid layer thickness of about 0.075–0.150 mm, and they will result in hardened coating layer thickness of 0.045–0.076 mm.

The invention is especially pertinent to the application of mica pigmented top coatings to base coatings having compatible solvents and pigments. In such instances it is important that the time between application of the base coating and the top coating be controlled. A preferred time between coatings is 0.5–10 minutes. The preferred method of applying coatings in accord with the invention is through the use of a turbobell rotary atomizer. In the practice of the invention uniform appearing coatings of durable nature are rapidly produced.

The foregoing and other objects, features and advantages of the present invention will become more apparent from the following description of the best mode.

BEST MODE FOR CARRYING OUT THE INVENTION

Complete details of the composition of the coatings to which the present invention is preferentially directed are given in the co-pending patent applications referred to in the Background and the disclosures thereof are herein incorporated by reference. See also the article by S. Panush, "A major extension in the use of color-base coat/clear coat" American Paint & Coatings Journal, May 16, 1983 pp. 52–61.

Metal oxide coated mica is used in the coatings to which the present invention applies, with the percentage being dependent on the appearance effect desired, as described further below and in the copending applications. Typical metal oxide encapsulated mica base pigments are described in U.S. Pat. Nos. 3,087,829 and 4,047,969 (the disclosures of which are hereby incorporated by reference), and in the article by C. J. Rieger "Use of Non-Metallic Pearlescent Pigments to Achieve Metallic Appearance", published as part of the proceedings of the 37th Society of Plastic Engineers Conference, New Orleans, May 9, 1979.

Substrates in the present invention will include metals, plastics and ceramics. They are prepared for painting in a normal way according to the particular material. This preparation can include common cleaning and the application of certain undercoat materials, including metallic and organic undercoats for smoothing, corrosion resistance, etc. For the purposes of this application the coating which is referred to is that which significantly influences the finished appearance of the article. The coating may be comprised of one or more layers. In the multilayer system referred to in patent application Ser. No. 526,724, the coating system is comprised of a first layer, called the basecoat and a second layer, called a topcoat. The present invention is particularly concerned with the application of the material which constitutes the topcoat of patent application Ser. No. 526,724 but it will also be applicable to a similar coating which may be applied by itself to a substrate; multiple topcoats also may be applied to an article.

The coating of the present invention will contain small ceramic platelets, preferably the metal oxide coated mica pigments referred to above, herein generally referred to simply as mica. These pigments have platelet thicknesses of the order of 0.25–1.0 micrometers. The particles are planar and their greatest planar dimension is referred to as the particulate length. The lengths of the pigments will in micrometers be between 5–60, preferably 5–45 and more preferably between 5–35. The pigments are used in both the basecoat and in the topcoat, and in both instances they affect the appearance. The basecoat typically has mica pigment weight percent in the 5–15 range and finished thickness (after hardening) is in the range 0.013–0.038 mm. These types of basecoats usually will have an unpigmented (transparent) topcoat applied to them both for protection and to provide "depth" of appearance.

The hardened coatings to which the present invention is pertinent tend to have smaller but still significant amounts of mica, in the range 0.01–5 weight percent. Preferably the mica weight percent is 0.07–2 and most preferably it is approximately 0.1, and the invention is most pertinent to these coatings. The other constituents of a topcoating will be such that it is essentially clear, to an extent that light may penetrate through the topcoat and be reflected back through the topcoating by the basecoat. Inasmuch as the amount of pigment in the topcoat is limited as indicated, the base layer influences the appearance of the coating. Inasmuch as the topcoat has pigment, particularly mica pigment, the topcoat is more influential on the appearance of the entirety of the coating system than is an unpigmented topcoat. Of course, the topcoat may be applied over basecoats with or without mica, or it may be used alone without a basecoat.

In both the more heavily pigmented basecoat application and in the more lightly filled topcoat application, the appearance of the coating is influenced by the precise manner in which the mica is included. But since the topcoat both transmits and refracts light, it has been found that closer control must be exercised over pigment distribution and orientation. Unlike mica containing basecoats which can be applied in a conventional manner substantially like that used for other pigmented coatings, the application of topcoats containing mica is more critical as described herein. One reason underlying this is that coatings containing mica particles are found to be physically different from earlier coatings which contained aluminum particles. Even through the aluminum pigment is nominally platelet in form, in fact it is malleable and highly irregular in shape when viewed microscopically. In contrast, mica is a friable ceramic material and the planar platelet shape is maintained during processing and preserved in the final coating as is shown by photomicrographs in the related applications. While we have not done an extensive investigation of the phenomena underlying our observations, apparently the mica platelets can undesirably tend to preferentially align with respect to the surface of a coated article. This leads to variation in appearance of such an article compared to one in which the pigments are more randomly and more desirably oriented. In contrast the convoluted shape of aluminum pigments mean coatings containing such pigments are less sensitive to being preferentially oriented and thereby affecting appearance with a given angle of incident light.

It has been found that the problem of non-random orientation of mica is aggravated when the rotary type atomizers are used. Such atomizers are characterized by being able to apply relatively high volumes of material, in comparison to the air atomizers (two-fluid methods). Notwithstanding the aesthetic judgment which may be made as to what type of mica containing coating looks best, there are substantial problems which result when a coating which has predominantly been applied by a rotary atomizer is subsequently matched with another article which has been coated with an air atomizer. The invention we disclose herein is based on the discovery that if the parameters of applying coatings containing mica particulates are carefully controlled, then consistent and pleasing results can be obtained.

The following is an example of the practice of the invention. A composition is prepared by first making a copolymer by reacting 47 parts of butyl methacrylate, 37 parts of styrene, 15.75 parts of hydroxypropyl methacrylate and 0.25 parts of methacrylic acid with 176 parts of xylene and butanol (in a weight ratio of 85/15).

Preferably, for an automotive vehicle body, the steel substrate will have applied to it a basecoat comprised of the aforementioned copolymer with the inclusion of 7.5 weight percent of a pigment base made by blending 99.77 parts of rutile titanium dioxide with 0.22 parts carbon black and 0.01 parts indathrone blue. The prior coating will have been allowed to harden at 20°-30° C. (nominal room temperature) for about 2 minutes, to become tacky.

The topcoat is made by blending 144 parts of the unpigmented copolymer solution described above at 45% nonvolatiles with 58 parts of 60% nonvolatile solution of butylated methylol melamine. The topcoat will be about 50-60 weight percent solids and will have a 20°-30° C. viscosity of about 1.05 Pa·s. It is applied to the workpiece at a rate of about 4-10 ml/s using a conventional rotary atomizer, such as a Ransburg turbobell system No. 253-17264/98743-05, having a bell that is 7-8 cm diameter and 16 mm depth. The workpiece being coated translates past the atomizer bell at a rate of 70 mm/s at a distance of about 0.2-0.4 meters, preferably 0.3 meters. The bell rotates in the range of 10,000-50,000 rpm, preferably 20,000 rpm. An electrostatic field is applied between the workpiece and the bell in the conventional manner, with a field voltage of 105-115 kilovolts, preferably 110 kilovolts. Shaping air at about 200 kPa is applied to produce a droplet plume directed toward the workpiece.

The aforementioned flow rate, translation speed, and spacing parameters are adjusted as needed for the particular article to produce in a single pass a topcoating thickness after hardening which is in the range of 0.045-0.076 mm, preferably 0.058±0.0076 mm (0.051-0.066 mm). Calculation according to a typical solvent content of nominally 40-50 volume percent shows that the liquid layer formed on the surface of the article has a momentary thickness at the time of deposition of about 0.075-0.150 mm, preferably 0.085-0.13 mm, and in all instances more than the nominal maximum 0.060 mm mica length. The mica weight percent ranges stated above for hardened topcoats will be produced by depositing liquids containing the following nominal weight percents of mica: generally 0.005-2.5, preferably 0.03-1, most preferably about 0.05.

Our invention is particularly important because it is pertinent to modern coatings which have high solids contents, e.g., more than 40 percent by weight, and typically 55-60 percent. These coatings will tend to have mica pigment loadings as indicated above and they may include other pigments as well. Inherently our topcoatings will have low pigment loadings because of the above referred to visual effects we desire, and thus their viscosities will tend to be low in the range of $1.05-1.4\times10^{-3}$ Pa·s.

Transparent coatings made within the aforementioned procedure will have an essentially random orientation of mica pigment and therefore will tend to appear generally the same. Of course, it was previously known that certain parameters must be observed in rotary atomizing, and these broad limits apply to the present invention. For example, the coating is deposited at a rate sufficient to avoid the undesirable appearance which occurs when the droplets dry before they hit the workpiece. Also, the material is applied at a rate and with a localized distribution which is less than that which causes running of the liquid across the workpiece surface. But, there are other criticalities which were not previously evident. When spraying liquids containing mica particles, if the bell speed is less than or more than that indicated, the coating will tend to appear dark. That is, the mica particles will not reflect and refract the light in the desired way. In contrast, with aluminum pigment very high bell speed, beyond the range indicated, tends to give a more desirable appearance, compared to low speed. With mica the converse is true. Similarly, low voltages and high voltages, outside the aforementioned range tend to give poorer appearance. In contrast a topcoat of the aforementioned composition which does not contain any mica pigments may feasibly be applied with a voltage in the range of 90-120 kilovolts. We speculate that the electrostatic field voltage combines with the irregular shape of the mica pigment and the inherent behavior of charged particles and causes a preferential orientation of the mica pigment as it either flies through the air or rests on the surface of the workpiece while it is still immersed and mobile in the liquid layer. The precise dynamics of the turbobell process are beyond the scope of this document. But, put simply, both speed and applied voltage influence droplet size, with higher values of each reducing the size. Reduced size is associated with increased surface area and increased solvent volatilization. Target distance influences also the composition of the droplets as they move toward the target. As the further discussion herein indicates the thickness of the liquid layer is important in enabling random distribution of mica. But it follows as well that the composition and thus the viscosity of the liquid is influential as well.

Accordingly, the criticalities in application for the aforementioned use of the turbobell will be pertinent to coatings which have similar physical properties and behavior as a deposited liquid layer. The method will be applicable to thermosetting or thermoplastic resins, especially acrylic resins. It will include the application of acrylics, urethanes, polyester, alkylds and blends thereof.

Examining coatings which have been made and considering the foregoing observed phenomena has led to the following general conclusions: The coating liquid must be deposited on the workpiece surface with parameters which enable the mica to become randomly oriented within the liquid. To achieve this, it is necessary to form a liquid layer on the article. That is, if droplets are deposited in too spaced apart fashion or at an insufficiently high rate, there will not be produced a continuous liquid layer within which the mica may be mobile.

It is necessary that the liquid layer which is formed on the workpiece have a thickness which is related to the length of the pigment. Specifically, the layer must have a thickness sufficient to enable free orientation of the pigment particles within the deposited layer, so that they may physically assume a random orientation. Essentially, we have found that the nominal thickness of the liquid layer which is deposited must exceed the nominal maximum pigment platelet length. For example, with 5–60 micrometer mica pigments, the liquid layer which is formed would be at least 60 micrometers thick as measured normal to the article surface.

While the sufficient thickness of liquid layer enables free orientation, from the data presented herein it can be appreciated that the hardened layer may have a thickness which is less than the maximum length of pigment which is included in the coating. For example, a 0.045 mm final thickness with 0.060 mm maximum particles. On one hand such overlength pigments tend to resist protruding through the hardened coating surface due to surface tension phenomena. But on the other hand the increasing viscosity of the coating as it hardens and shrinks toward the surface would tend to preserve pigment orientation. While we have not assessed in detail the hypothetical forces which tend to work for and against the object of our invention, a certain portion of the pigment particles may be deflected from free orientation as the coating hardens in the practice of our invention at its limits. Nonetheless, our observation is that coatings made within our set forth ranges will have the appearance which characterizes essentially random orientation of pigment. Thus we conclude that the important aspect of our invention is in the method of applying the coating, specifically, in ensuring that there is sufficient liquid present initially. Certainly it is preferred that the final hardened thickness at least approximate or equal the length dimension of the great majority of the particles. Similarly, we appreciate that the size ranges of pigment platelets are not absolute. As with virtually all particulate distributions, there may be a few percent of particles which exceed the specified dimension limits. Here again, at the limits of the invention, such small number of overlength particles could be in violation of our liquid layer thickness criterion. But so long as they are small in number they will tend to not be strongly influential on coating appearance. Accordingly, when we refer to the maximum pigment particle length which the liquid layer must exceed we are referring to the nominal maximum particle size as it is understood in the field.

Our topcoating is most desirably applied to an article having a prior coat, or a basecoat, made with compatible solvents and polymers, as indicated by the example. In such instances, it is important that the time between the application of the first basecoat and the second topcoat be carefully controlled, to preserve the dynamics which we have found necessary in our mica pigmented topcoats. If the second coating is applied too early, before hardening of the first coat, then there will be interaction of the ingredients of the coatings with unwanted effects on the physics of the topcoat liquid layer. If the second layer is applied too late, then there is risk that the layers will be inadequately bonded together for durability. We have found that for acrylic thermosetting or thermoplastic coatings, the time between the completion of the first coating and the start of the second coating must be in the range 0.5–10 minutes. The same limitations will apply when multiple mica containing topcoats are applied.

Our invention will be applicable to thermosetting and thermoplastic coatings of diverse nature, wherever it is desired to obtain the desired appearance which metal oxide coated mica provides. Thus, it is not limited to the compositions indicated, but will be pertinent to whatever other binder and polymer systems are compatible with mica filled coatings and which liquids physically behave with respect to the mica in a manner analogous to that we describe herein. While we prefer the above mentioned electrostatic turbobell apparatus other rotary and nonrotary devices which carry out the objects of the invention will be useful. These methods will include the methods referred to in the background section, with or without electrostatic field applied.

Although this invention has been shown and described with respect to a preferred embodiment, it will be understood by those skilled in the art that various changes in form and detail thereof may be made without departing from the spirit and scope of the claimed invention.

We claim:

1. The method of applying a thermoplastic or thermosetting coating to the surface of an article, wherein the coating is formed from a liquid containing a polymer, a volatile solvent and very fine ceramic pigment platelets, which comprises atomizing the liquid to form droplets and impacting the droplets onto the surface at a rate sufficient to form a continuous liquid layer but insufficient to cause the liquid to flow across the surface, the layer having a thickness greater in dimension than the nominal maximum length of the ceramic pigment platelet lengths; and, volatilizing the solvent from the liquid layer to harden the layer into the coating, to thereby produce an essentially random platelet orientation in the coating.

2. The method of claim 1 wherein the ceramic pigment platelets in the liquid are metal oxide coated mica platelets having thicknesses between 0.25–1.0 micrometer and nominal lengths between about 5–60 micrometer.

3. The method of claim 2 wherein the liquid layer thickness is at least 0.075 mm.

4. The method of claim 1 wherein the liquid has a solids content of more than about 40 weight percent.

5. The method of claim 1 wherein the hardened coating contains 0.01–5 weight percent pigment platelets.

6. The method of claim 5 wherein the coating contains 0.07–2 weight percent platelets.

7. The method of claim 1 wherein the liquid which is atomized contains about 0.03–1 weight percent ceramic platelets.

8. The method of claim 1 wherein the article has on its surface a prior polymer coating containing a pigment, the prior coating and the liquid containing mutually compatible solvents and polymers, characterized by depositing the liquid onto the prior coating after the prior coating becomes tacky but before the prior coating becomes hard, to prevent pigment from the prior coating from significantly migrating into the coating formed from the liquid.

9. The method of claim 8 wherein the prior coating has a binder comprised preponderantly of an acrylic or urethane polymer and wherein the thermoplastic or thermosetting coating is applied between about 0.5–10 minutes after the first coating.

* * * * *